US009266588B2

(12) United States Patent
Shlinger et al.

(10) Patent No.: US 9,266,588 B2
(45) Date of Patent: Feb. 23, 2016

(54) ADJUSTABLE SURFING FIN

(71) Applicants: Adiel Shlinger, Rishon LeZion (IL); Dekel Tabibi, Rishon LeZion (IL)

(72) Inventors: Adiel Shlinger, Rishon LeZion (IL); Dekel Tabibi, Rishon LeZion (IL)

(73) Assignee: FLUX INNOVATIONS PTY LTD., Vaucluse (AU)

( * ) Notice: Subject to any disclaimer, the term of this patent is extended or adjusted under 35 U.S.C. 154(b) by 0 days.

(21) Appl. No.: 14/366,931

(22) PCT Filed: Nov. 29, 2013

(86) PCT No.: PCT/IL2013/050988

§ 371 (c)(1),
(2) Date: Jun. 19, 2014

(87) PCT Pub. No.: WO2014/087400

PCT Pub. Date: Jun. 12, 2014

(65) Prior Publication Data

US 2015/0000585 A1 Jan. 1, 2015

Related U.S. Application Data

(60) Provisional application No. 61/732,411, filed on Dec. 3, 2012.

(51) Int. Cl.

| | |
|---|---|
| ***B63B 39/06*** | (2006.01) |
| ***B63B 35/71*** | (2006.01) |
| ***B63B 35/79*** | (2006.01) |

(52) U.S. Cl.

CPC ..... *B63B 35/7926* (2013.01); *B63B 35/71* (2013.01); *B63B 39/06* (2013.01); *B63B 2035/715* (2013.01)

(58) Field of Classification Search

CPC ..... B63B 39/06; B63B 35/71; B63B 35/79
USPC ..... 441/79
See application file for complete search history.

(56) References Cited

U.S. PATENT DOCUMENTS

| | | | | |
|---|---|---|---|---|
| 4,733,496 | A | 3/1988 | Wallner | |
| 5,367,970 | A | 11/1994 | Beauchamp et al. | |
| 5,649,846 | A * | 7/1997 | Harper et al. | 441/79 |
| 6,896,570 | B1 | 5/2005 | O'Keefe et al. | |
| 7,896,718 | B2 | 3/2011 | Jones | |

FOREIGN PATENT DOCUMENTS

| | | |
|---|---|---|
| EP | 79113 | 5/1983 |
| JP | 2004284567 | 10/2004 |
| WO | WO2011143695 | 11/2011 |

OTHER PUBLICATIONS

International preliminary report on patentability for related PCT/IL2013/050988 mailed Jun. 9, 2015.
International search report for related PCT/IL2013/050988 mailed Apr. 3, 2014.
JP2004284567—Translation from EPO Patent translate.

* cited by examiner

*Primary Examiner* — Lars A Olson
(74) *Attorney, Agent, or Firm* — Graeser Associates International Inc; Dvorah Graeser

(57) ABSTRACT

The invention is a fin for surfboards with a variable stiffness function. This is accomplished by means of a central disc that can be rotated to give different degrees of mechanical support to the fin when rotated to different angles, thus providing variable flexibility.

8 Claims, 9 Drawing Sheets

ADJUSTABLE SURFING FIN

This application claims the benefit of U.S. provisional application No. 61/732,411, filed Dec. 3, 2013.

BACKGROUND

1. Technical Field

Embodiments of the present invention relate generally to an adjustable surfing fin, which enables a surfer to adjust the fin's flexibility in order to achieve different surfing experiences.

2. Description of Related Art

Many watersports and aquatic activities use water-borne vessels having fins or keels beneath the surface of the vessel, adapted to allow steering of the vessel. Surfboards, windsurfing boards, and numerous other aquatic vessels use fins attached beneath the vessel in order to adjust or use the water flow beneath the vessel for steering and/or stability.

The characteristics of the fin, such as its level of flexibility, its size, its curves and its surface area all affect the water flow beneath the vessel and how the vessel reacts to steering operations.

Due to variability in the conditions of the high seas and different personal preferences of surfers, various fins have been developed in order to affect water flow differently, and thus to steer vessels differently and create different surfing experiences.

Surfboards manufactured today provide a base beneath the board, upon which a desired fin may be reversibly mounted. If a surfer desires a different fin, as a result of changing conditions or a different surfing style, the attached fin must be dismounted, and an alternative fin be mounted in its stead. Thus, a surfer wishing to change the flexibility or any other attribute of their fin must not only spend time and effort replacing a fin every time they wish to change their surfing experience, they must also carry around alternate/replacement fins. This may be true every time a surfer goes to surf, partially due to the inability to predict which fin they will need during the entirety of the surfing session.

Additionally, the surfer may not notice the unsuitability of their fin until reaching a certain distance from shore (e.g. where the waves are peaking), which would then require them to return to shore in order to replace said fin. Acquiring a set of fins for different surfing experiences may be expensive, as well as bulky when traveling.

U.S. Pat. No. 6,896,570 B1 describes a fin for a watersport board, which includes a substantially rigid core covered by a flexible core covering.

EP 79,113 A1 describes a fin for buoyant support suitable for a surf board, dinghy or wind sailing board or the like, formed of a resiliently flexible material such as solid urethane, reinforced with a stiffening insert which incorporates means for attachment to the surf board or the like.

What is common to the above inventions is that the fin allows for a fixed degree of flexibility and must be replaced every time a different flexibility is required.

U.S. Pat. No. 4,733,496 describes a novel fin for surfboards and watercraft that includes a pivoting rudder-like section that swings out when a turn is commenced, enhancing the maneuverability of the surfboard by reducing the resistance of the fin as it moves sideways through the water in a turn and by redirecting the water flow through the pivoting rudder section in the direction of the turn. Although said fin does provide left-right maneuverability, it does not provide the ability to change other aspects, such as flexibility, of the fin.

U.S. Pat. No. 5,367,970 discloses a fin which is able, given the material that is used in its manufacturing process, to provide extra flexibility. This invention, however, relates to a fin manufactured by a specific process, and does not providing different levels of flexibility.

WO 2,011,143,695 describes a fin for a surf craft. Said fin is able, given the material that is used in its manufacturing process, to provide extra flexibility. This invention however does not providing different levels of flexibility.

U.S. Pat. No. 7,896,718 describes a keel or fin for a watercraft such as a surfboard that is conventional in shape with a major portion fixed to the board by peg and a minor, flexible, trailing portion fixed to the major portion. This invention however relates to a single adjustable fin which is comprised of an adjustable piece attached to it, giving it minimal flexibility.

None of the methods found provide for variable flexibility, and hence an improved method for variable flexibility in a surfing fin is still a long felt need.

BRIEF SUMMARY

According to an aspect of the present invention, there is provided a surfing device comprising a single fin, with a central disc that can be rotated to give different degrees of mechanical support to the fin when rotated to different angles, thus providing variable flexibility. The fin is formed with a disc-shaped indentation, into which the disc fits. The disc has indentations on its surface.

Protruding from the disc-shaped indentation of each of the sides of the fin are inward-facing protrusions, corresponding in size and shape to the indentations on the disc.

The disc is in mechanical communication with a round plug having a slot approximately the size of a screwdriver blade. This allows the surfer to adjust the disc by turning it with a screwdriver, as detailed below.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

In order to understand the invention and to see how it may be implemented in practice, a plurality of embodiments will now be described, by way of non-limiting example only, with reference to the accompanying drawings, in which.

DETAILED DESCRIPTION

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for providing a system and method for a surfing fin.

In the following detailed description, numerous specific details are set forth in order to provide a thorough understanding of embodiments of the present invention. However, those skilled in the art will understand that such embodiments may be practiced without these specific details. Furthermore just as every particular reference may embody particular methods, systems, yet not require such, ultimately such teaching is meant for all expressions notwithstanding the use of particular embodiments. Reference throughout this specification to "one embodiment" or "an embodiment" means that a particular feature, structure, or characteristic described in connection with the embodiment is included in at least one embodiment of the invention.

A preferred embodiment of this invention consists of a special 'variable rigidity' fin or keel, attached at its base to a surf board, which allows a surfer to quickly and easily adjust the flexibility and other features of the fin by use of an adjustable mechanism. As will be clear to one skilled in the art, the device allows for a versatile surfing experience. It allows the surfer to be able to adjust the flexibility of the fin without the need to return to shore. Furthermore, it saves the cost of a full set of fins, and is easier to carry and travel with than a full set of fins.

Figure 1:
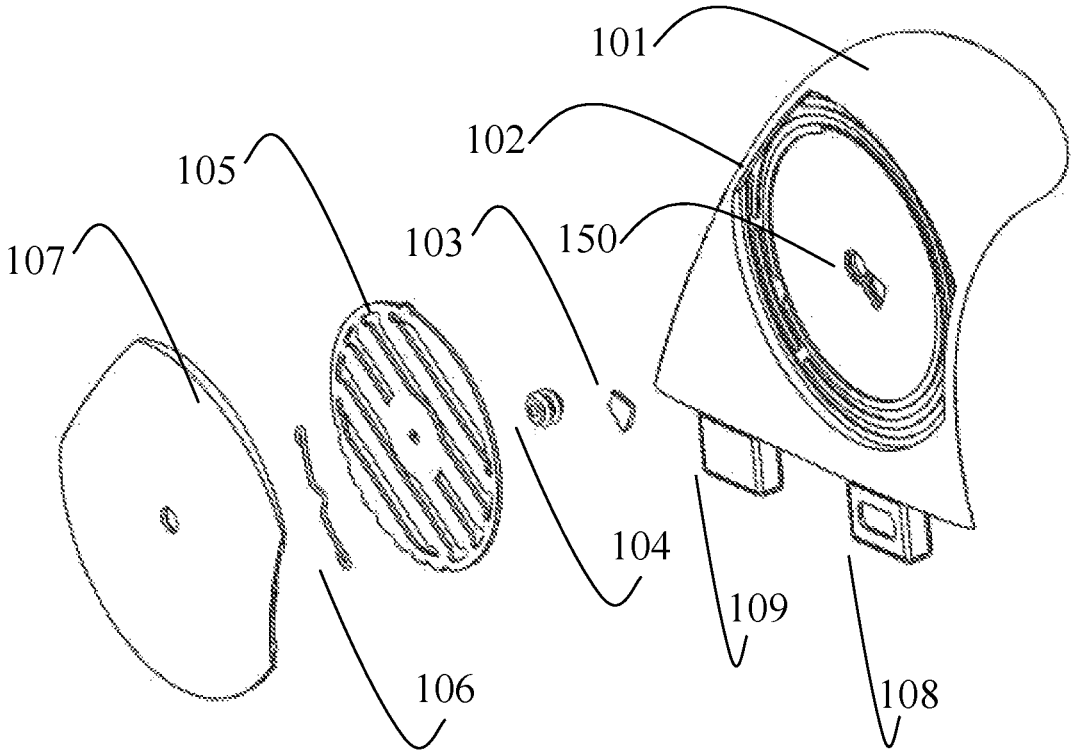
FIG. 1 illustrates an exploded view of the adjustable fin of the invention.

In FIG. 1 an exploded view is shown. The mechanism consists of a disc 105 that fits into the fin 101. The disc 105 may be rotated such that protrusions 102 on the base part of the fin align with different parts of the disc 105, leading to different degrees of support to the fin and differing subsequent flexibility of the fin. A spring-like pin 106 reversibly locks the disc into place. A plug, bearing or other circular part 104 holds the disc 105 in place while allowing rotation of the disc to various positions. A cover plate 107 fits over the disc and holds said disc in place while allowing it to rotate about plug 104.

The surfer may adjust the flexibility of the fin by inserting an object such as a screwdriver or wrench into the plug, and turning clockwise or counter-clockwise. This will cause the disc and its protrusions to rotate and lock into matching indentations and protrusions 102 on the fin part 101. Each locked position provides the fin with a different level of flexibility.

As the disc rotates within the fin, the protruding pieces move, and mate with the indentations on the disc. Due to the varying degree of coupling between disc and fin, different flexibilities are achieved and as a result a different surfing experience is achieved.

The device may be mounted on a surf board, windsurfing board, and other aquatic vessels which use fins or keels to manipulate the water flow beneath the vessel and thus facilitate maneuvering of the vessel itself.

FIG. 1 shows the disc 105 which is inserted between the two parts of the fin 101, 107 creating a rotatable device within the fin. The disc 105 has elements which fit in corresponding circular indentations in the fin 102, to lock the fin in place. In addition, a hole 150 is visible, within which an object may be inserted to adjust the disc which turns on a bearing or circular element 104. A spring 106 is used to force the disc into a set of stable positions.

Figure 2:
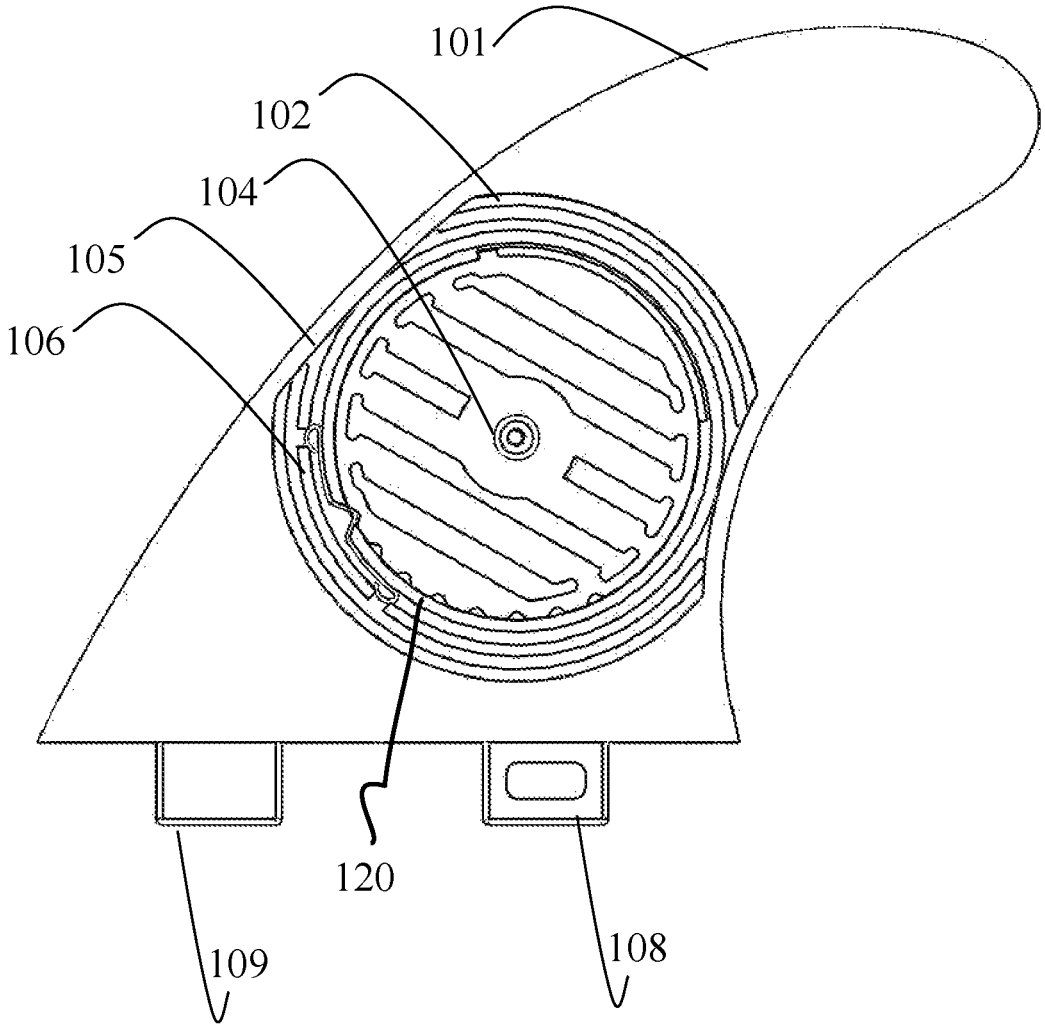
FIG. 2 illustrates the assembled fin in side view.

FIG. 2 illustrates the adjustable fin in side (port) view. The port surface of the fin has indentations and protrusions 102 which fit the disc 105, allowing the fin to rotate through a discrete set of reversibly fixed positions. Protrusions and indentations 102 fit into corresponding indentations and protrusions of the disc 105 and hold the disc securely into place in a discrete set of positions, allowing for different flexibilities. Indentations 120 fit the protrusion of spring 106, defining a discrete set of stable positions as will be clear to one skilled in the art.

Figure 3:
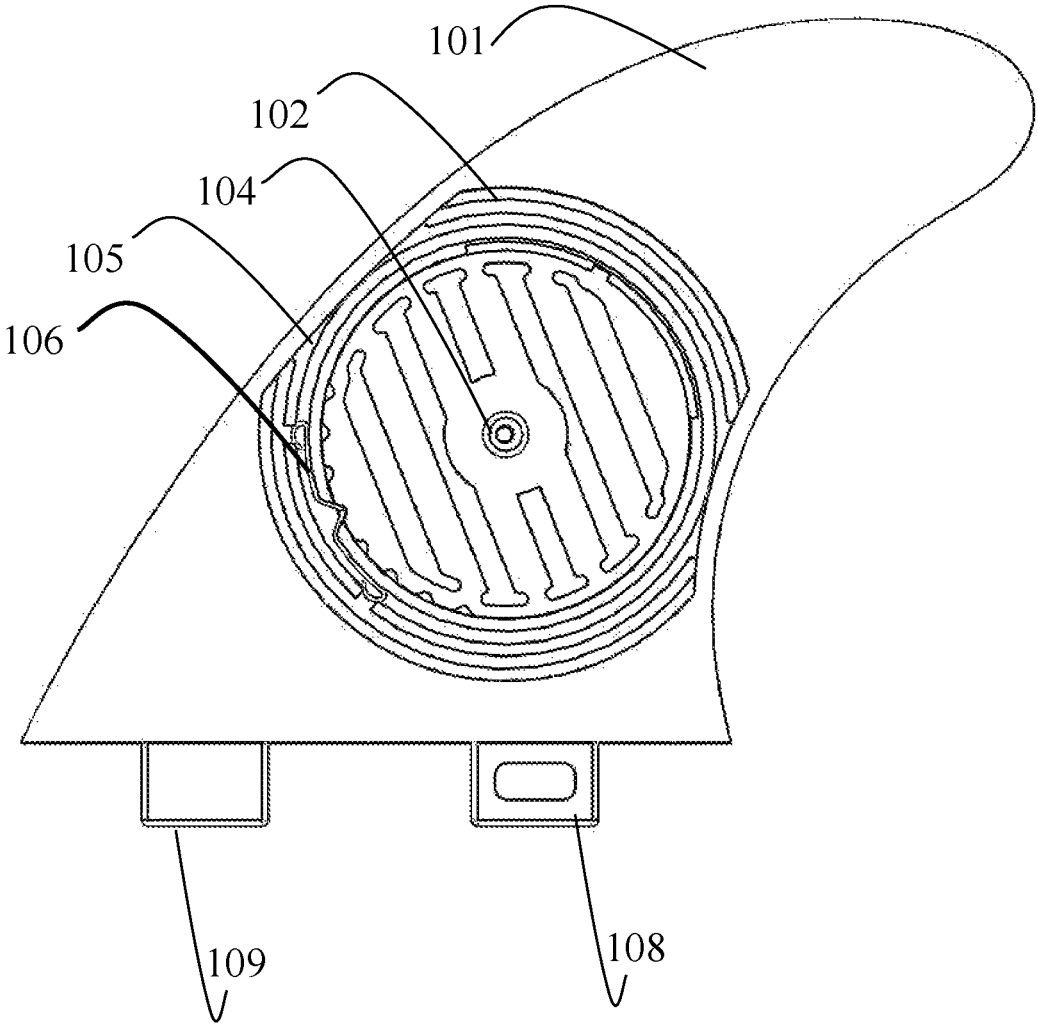
FIG. 3 illustrates the assembled fin in side view in a different disposition.
Figure 4:
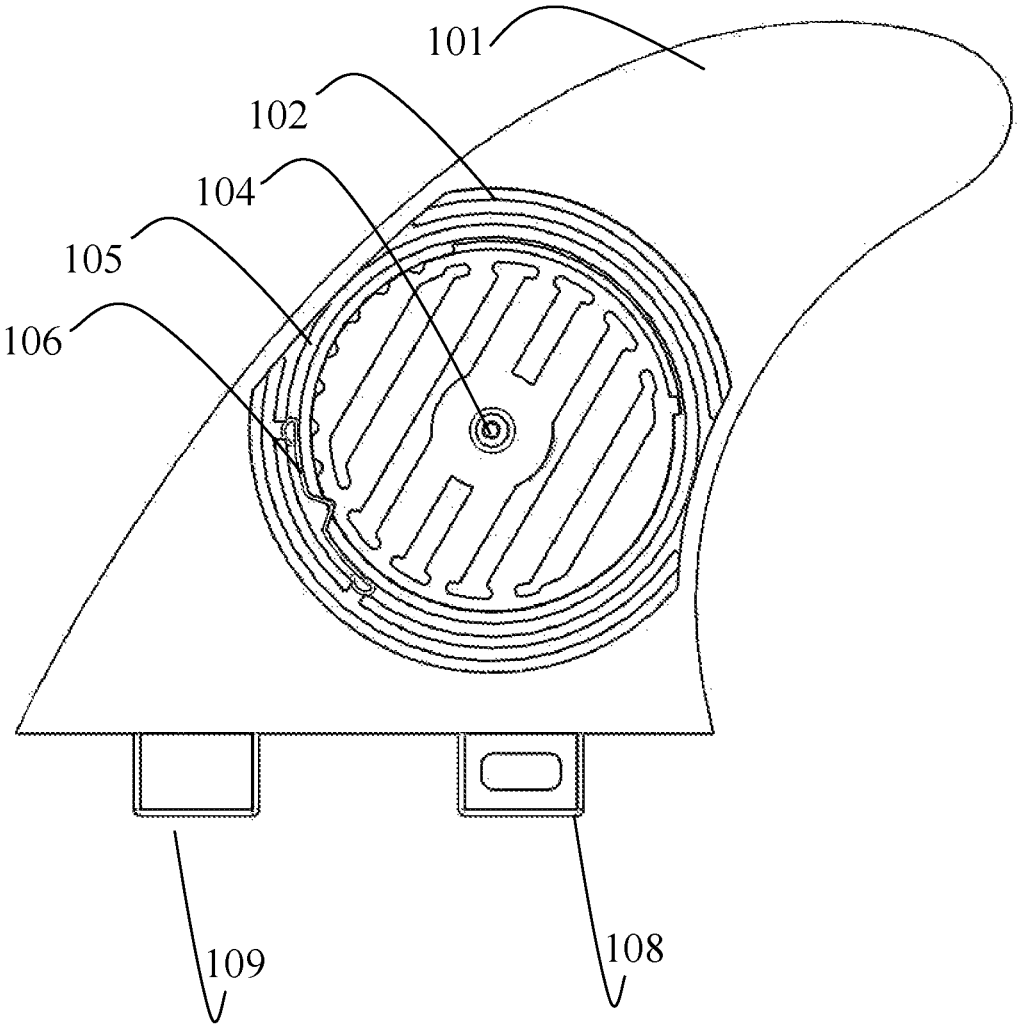
FIG. 4 illustrates the assembled fin in side view in a different disposition.

FIGS. 3, 4 show the disc 105 after having been rotated to different positions to achieve different fin flexibilities.

Figure 5:
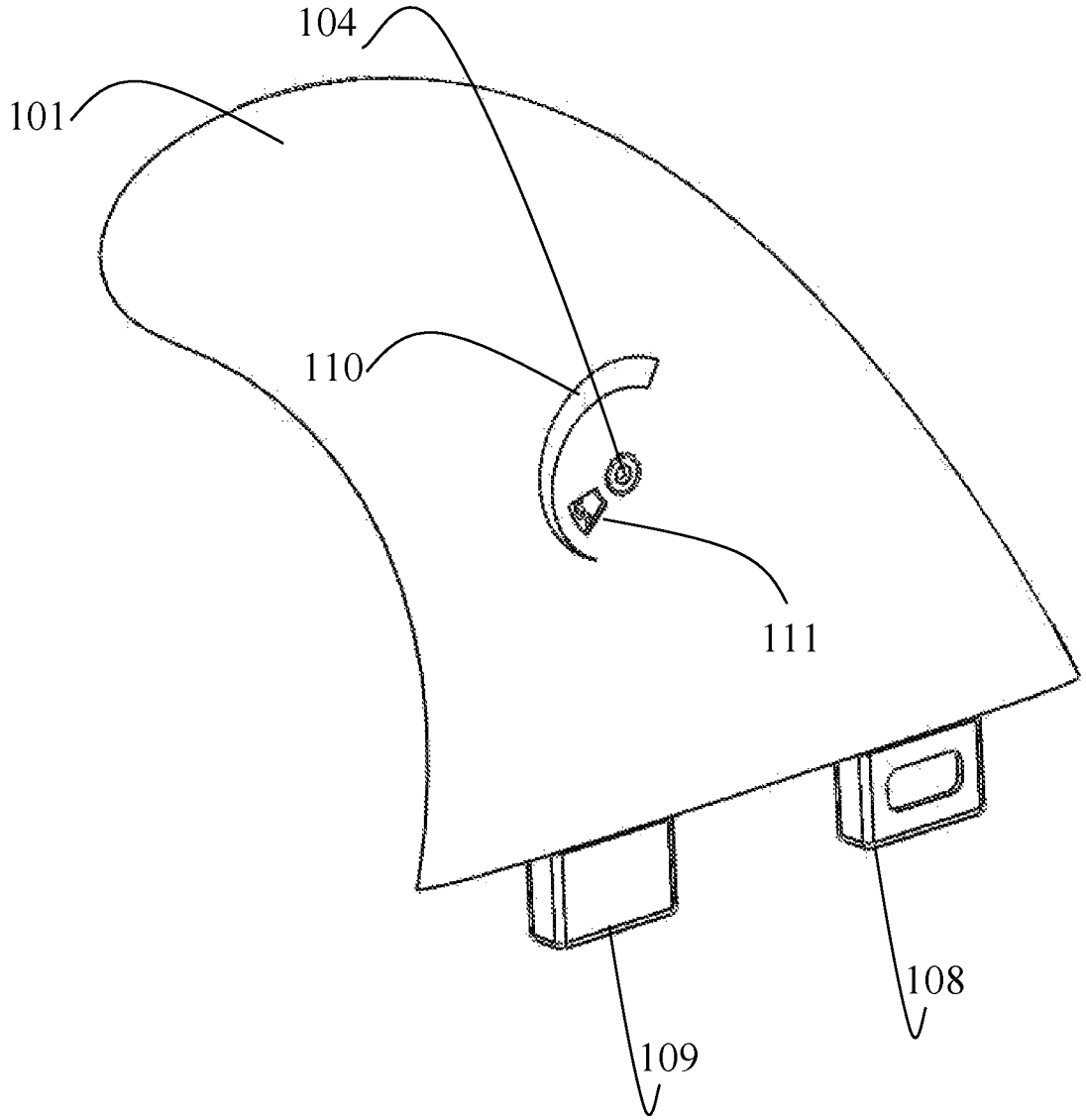
FIG. 5 illustrates the assembled fin in perspective view from the starboard side.

FIG. 5 shows the fin from the starboard side. The axis 104 is visible, as well as an indicator 111 showing a number indicating the disc position.

Protrusions 108, 109 allow the device to be connected easily to a surfboard or the like, by means of standard connectors such as the tabs shown.

Figure 6:
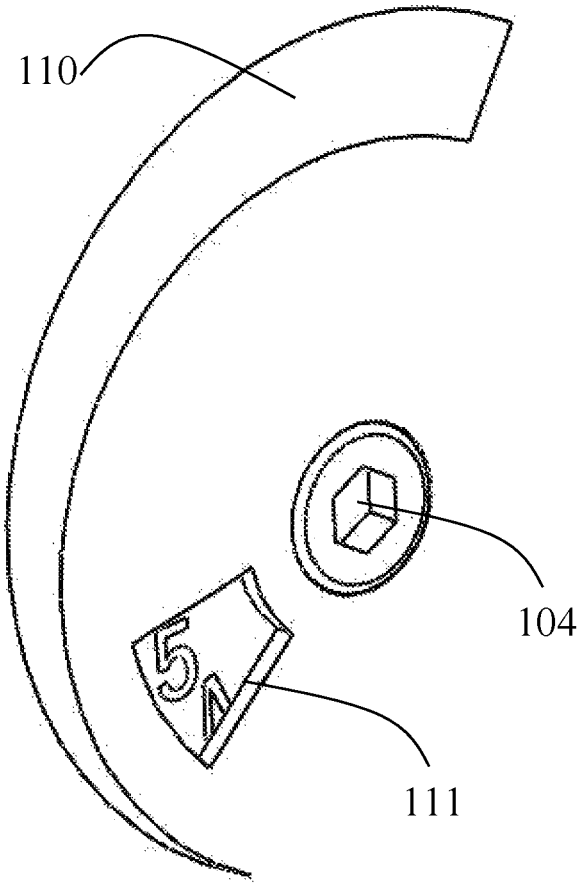
FIG. 6 illustrates the assembled fin in perspective view from the starboard side in closeup view.

FIG. 6 shows the scene of FIG. 5 in closeup view, with indicator 111 indicating position '5', axis 104 and crescent cutout 110.

Figure 7:
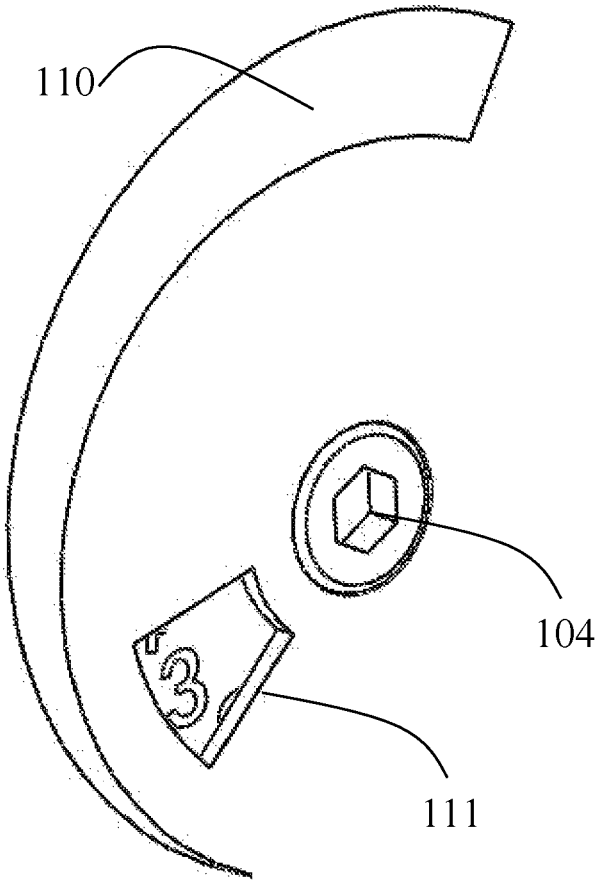
FIG. 7 illustrates the assembled fin in perspective view from the starboard side in closeup view.
Figure 8:
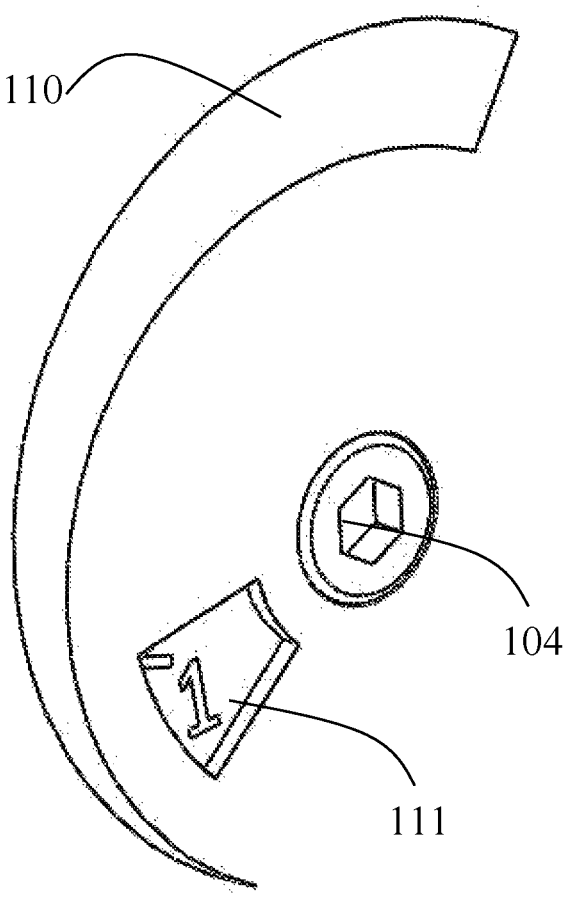
FIG. 8 illustrates the assembled fin in perspective view from the starboard side in closeup view.

FIG. 7 shows the scene of FIG. 6 where the disc has been rotated to position '3', and FIG. 8 shows the fin after the disc has been rotated to position '1'.

Figure 9:
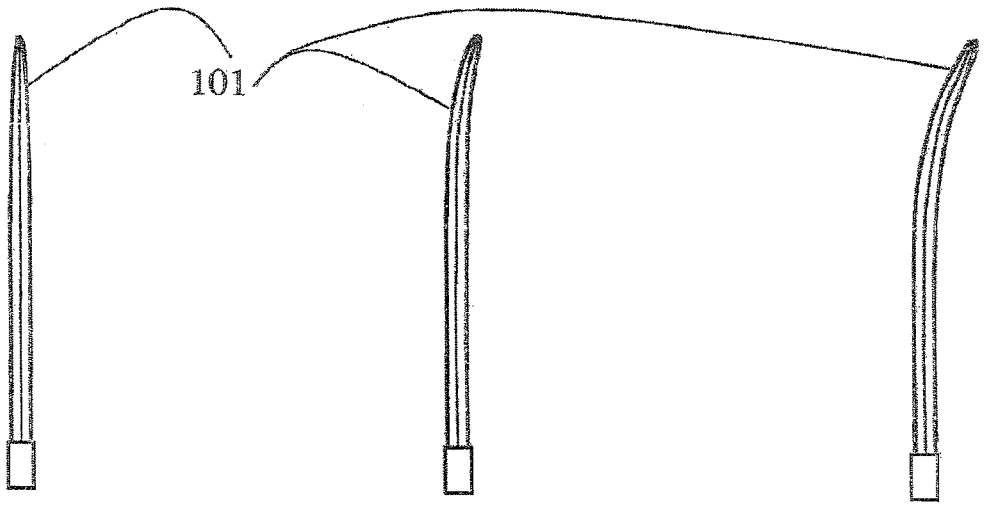
FIG. 9 illustrates the variable stiffness of the fin in a head-on view.

FIG. 9 shows the fin in a front view, allowing one to appreciate the standard thickness of the fin. The adjustable flexibility of the fin is also apparent here, as on the right the fin has flexed due to a given force while on the left it has not due to increased stiffness.

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

What is claimed is:

1. A fin of variable stiffness consisting of:

a base part adapted to fit into fittings of a waterborne vessel, said base part having indentations and protrusions;

a disc part adapted to fit into said protrusions and rotate within said base part around an axis;

a bearing adapted to center said disc and hold it in place while allowing for rotation of said disc;

wherein a variable degree of flexibility is imparted to a single adjustable fin.

2. The fin of claim 1 wherein said waterborne vessel is selected from the group consisting of: surfboard; kitesurf board; windsurf board; boogie board; paddle board; wave board; wake board; kayak; canoe; sailing boat; waterski and jetski.

3. The fin of claim 1 further comprising means for rotating said disc by means of a screwdriver.

4. The fin of claim 1 further comprising means for rotating said disc by hand.

5. The fin of claim 1 further comprising means for rotating said disc by means of a cord.

6. The fin of claim 1 wherein variable mechanical stiffness is provided to said fin along the port-starboard axis.

7. The fin of claim 1 further comprising protrusions allowing for installation of said fin onto waterborne vessels.

8. The fin of claim 1 further comprising a series of indentations adapted to accommodate a spring to define a set of stable positions of said disc.

* * * * *